US005355352A

United States Patent [19]

Kobayashi et al.

[11] Patent Number: 5,355,352

[45] Date of Patent: Oct. 11, 1994

[54] ELECTRONIC DEVICE DESIGNED TO PERMIT DETACHABLE ATTACHMENT OF AN EXTERNAL MEMORY DEVICE THERETO

[75] Inventors: Tuneo Kobayashi, Tokyo; Kazunori Kita, Mizuhomachi; Satomi Suzuki, Tachikawa, all of Japan

[73] Assignee: Casio Computer Co., Ltd., Tokyo, Japan

[21] Appl. No.: 955,751

[22] PCT Filed: Apr. 15, 1992

[86] PCT No.: PCT/JP92/00474

§ 371 Date: Dec. 17, 1992

§ 102(e) Date: Dec. 17, 1992

[87] PCT Pub. No.: WO92/20017

PCT Pub. Date: Nov. 12, 1992

[30] Foreign Application Priority Data

Apr. 24, 1991 [JP] Japan ..... 3-122101
Jun. 24, 1991 [JP] Japan ..... 3-178848
Jun. 24, 1991 [JP] Japan ..... 3-178849

[51] Int. Cl.[5] ..... G04B 37/00

[52] U.S. Cl. ..... 368/281; 368/10; 368/41; 368/223

[58] Field of Search ..... 368/10, 281, 282, 223–239, 368/41

[56] References Cited

U.S. PATENT DOCUMENTS 5,181,192 1/1993 Paratte et al. ..... 368/282

FOREIGN PATENT DOCUMENTS 2641092 6/1990 France .
2078401A 1/1982 United Kingdom .
2159304A 11/1985 United Kingdom .

*Primary Examiner*—Bernard Roskoski
*Attorney, Agent, or Firm*—Frishauf, Holtz, Goodman & Woodward

[57] ABSTRACT

A wrist watch (1) is provided with a cover member (3) attached to a wrist watch case (2) by a coupling portion (3) in a openable/closable manner. A liquid crystal display device (4) to display time is incorporated in the cover member (3). A retaining section (7) for retaining a disk-like data memory is provided on the upper surface of the wrist watch case (2). The data memory in the retaining section (7) is securely held with the cover member (3) closed. Data in the disk memory (9) is read and processed by the electronic circuitry (*2b*) of a watch, and is sent to the liquid crystal display device (4) via a flexible circuit board (*2e*). The data is then converted into a time which is in turn displayed. The data memory can therefore be very easily attached or detached, and is securely held. The wrist watch itself can be made compact. Replacing the data memory with another one can provide advantages such as displaying various types of data.

14 Claims, 17 Drawing Sheets

ELECTRONIC DEVICE DESIGNED TO PERMIT DETACHABLE ATTACHMENT OF AN EXTERNAL MEMORY DEVICE THERETO

BACKGROUND OF THE INVENTION

1. Field of the Invention

The present invention relates to an electronic device, and more particularly, to an electronic device so designed that an external memory, which has various pieces of data and programs stored therein and contains a control circuit or the like, can detachably be installed in this device.

2. Description of the Related Art

In an electronic device, particularly, a portable electronic device, such as an electronic notebook designed to be capable of storing telephone number data, address data, schedule data, etc., an internal memory cannot have a large memory capacity, limited by the portability and cost of the device.

In this respect, electronic devices designed to permit detachable installation of an external memory thereto have been proposed. Among them is, for example, a type which allows an IC card, a ROM pack, CD (compact disk) or the like to be detachably attached to the electronic devices.

This type of an electronic device that permits detachable installation of an external memory thereto is so designed as to permit different data and programs of different purposes (dictionary, name cards management, etc.) to be stored in different external memories and allow a user to change the installed external memory according to the purpose.

In such a conventional electronic device, a memory retaining section for accommodating the external memory is formed in the body case of the device, and is to be generally covered with a cover after the external memory is retained in that memory retaining section.

To provide the space for the cover, the conventional electronic device that is demanded to be compact has a retaining section for an external memory formed in a free or unused area on the side, bottom or top of the body case.

In this conventional electronic device, with external memory retaining section formed on the side or bottom of the body case, it is inevitable that a user should the position of the electronic device or turn the device upside down to install or detach an external memory. This work of installation and detachment of an external memory is troublesome and deteriorates the usability of such an electronic device.

If the external memory retaining section is formed on the top of the body case, however, it is inevitable to restrict the sizes of a key input section and a display section or other members, which are normally provided on the top of the body case. This design requires that keys be made smaller or the display section be designed smaller, which is not desirable in view of good operability and high visibility of information.

In the conventional electronic device, the external memory and the retaining section have a predetermined positional relationship such that the external memory cannot electrically be connected to the body case unless the external memory is placed in a predetermined state in the retaining section. This conventional structure necessitates that the user should check the positional relation every time when placing the external memory in the retaining section, taking time in replacing the external memory with another one.

SUMMARY OF THE INVENTION

It is an object of the present invention to provide an electronic device which does not have the aforementioned shortcomings, and is therefore designed to facilitate the installation and detachment of an external memory as well as ensure the effective use of the surface space of the body case.

To achieve this object, according to the present invention, there is provided an electronic device for permitting detachable installation of an external storage medium, comprising an external storage medium for storing data; a body case formed with a retaining section for accommodating the external storage medium; a cover member so attached to the body case as to open and close the retaining section, and hold the external storage medium retained in the retaining section when closed, the cover member provided with an optical display device; and electronic circuitry means for receiving data stored in the external storage medium and supplying a display signal to the optical display device.

With the above structure, the present invention can provide large display space and ensure good electric connection between an external memory and the body case as well as significantly facilitate the attachment and detachment of the external memory.

DETAILED DESCRIPTION OF THE PREFERRED EMBODIMENTS

Preferred embodiments of the present invention will now be described referring to the accompanying drawings.

First Embodiment

FIGS. 1 to 10 illustrate an electronic device according to the first embodiment of the present invention.

Figure 1:
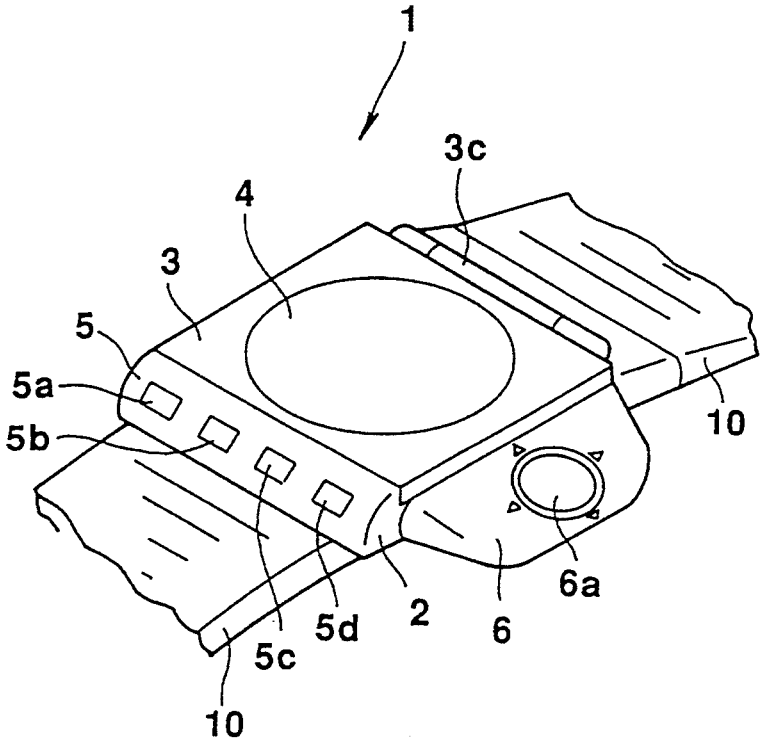
FIG. 1 is a perspective view of a wrist watch according to the first embodiment of the present invention.
Figure 2:
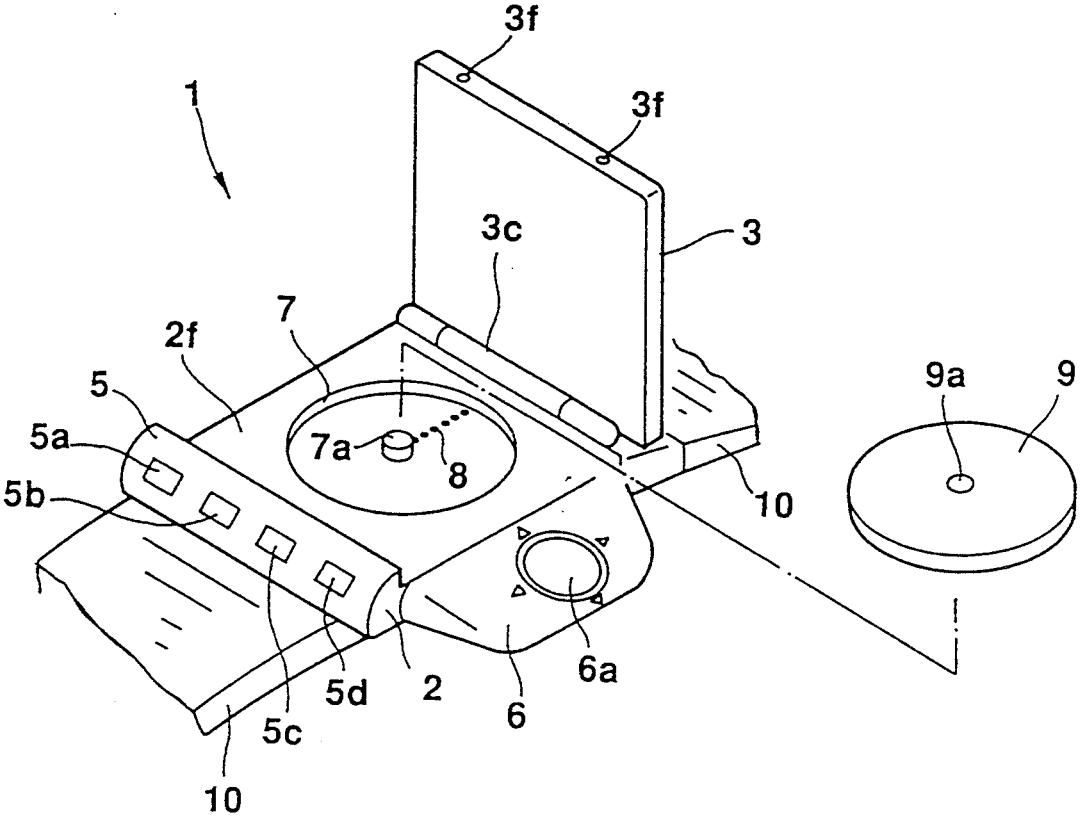
FIG. 2 presents a perspective view of the wrist watch shown in FIG. 1 with its cover 3 open and a perspective view of an IC coin memory which is to be installed in the wrist watch.
Figure 3:
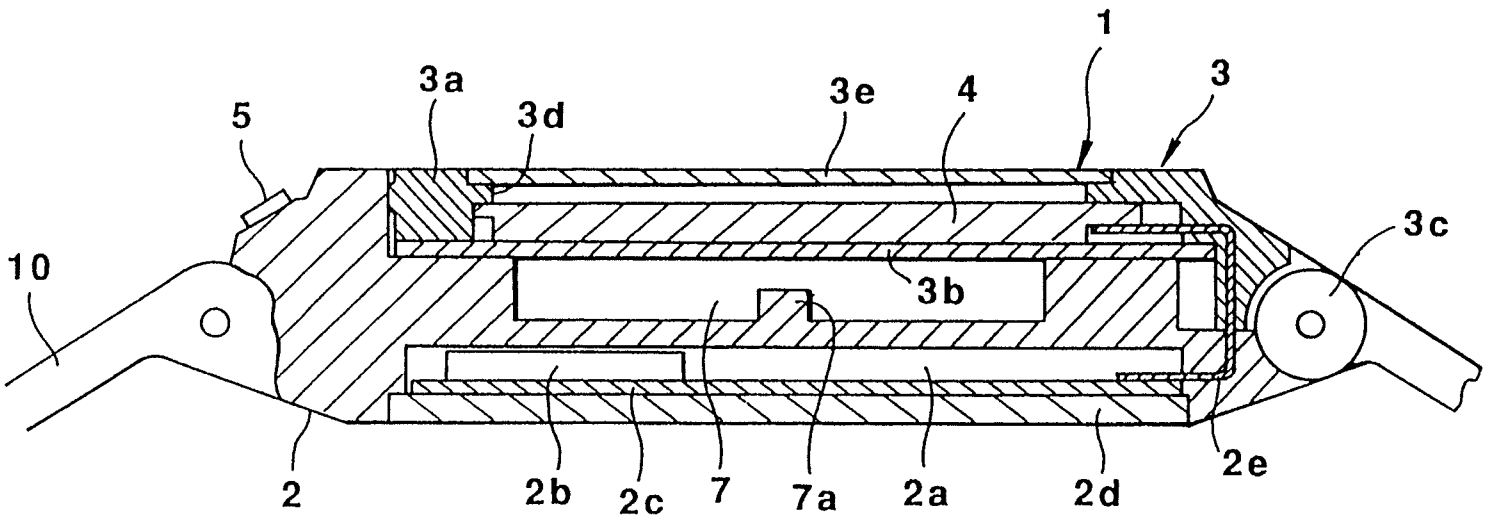
FIG. 3 is a cross section of the wrist watch shown in FIG. 1.

FIGS. 1 and 2 present perspective views of a wrist watch 1 as an electronic device, and FIG. 3 is a cross section of the wrist watch. The wrist watch 1 has a body case 2, and a cover (cover portion) 3 provided on a cover retaining section 2*f* on the top of the body case 2.

The cover 3 comprises a top cover case 3*a* and bottom cover case 3*b* as shown in FIG. 3, and is connected via a coupling section 3*c* to the body case 2 in an openable/closable manner. The cover 3 has an opening 3*d* formed in the top surface where watch glass 3*e* is attached, and has a display section 4 provided inside. The display section 4 is constituted of, for example, a liquid crystal display device, and is capable of displaying information of watch functions, such as year, month, day, day of week, and time, and various types of information presentable by an information device, such as telephone book data, name card data, schedule data and dictionary data. A projection 3*f* is provided on the side of the top cover case 3*a*, and serves to prevent the cover from opening by some shock when abutting on the side wall of the cover retaining section 2*f* of the body case 2.

The body case 2 is provided with a key operation section (key input section) 5 and a scroll operation section 6, with a memory retaining section 7 formed at the lower portion of the cover 3 as shown in FIG. 2. The key operation section 5 includes various keys 5*a*, 5*b*, 5*c* and 5*d*, and the scroll operation section 6 includes a scroll key 6*a*. The keys 5*a*, 5*b*, 5*c* and 5*d* of the key operation section 5 are used, for example, to adjust the date in watch mode and input various types of information in information mode. The scroll key 6*a* is used to instruct the up, down, right or left scrolling of the data displayed on the display section 4.

The memory retaining section (retaining section) 7 is formed into a columnar recess, with multiple contacts (terminals) 8 arranged in a line at the bottom of the retaining section 7. The contacts 8 are made of a conductive flexible rubber member or flexible metal or the like. A projection 7*a* is formed in the center of the memory retaining section 7.

Figure 4:
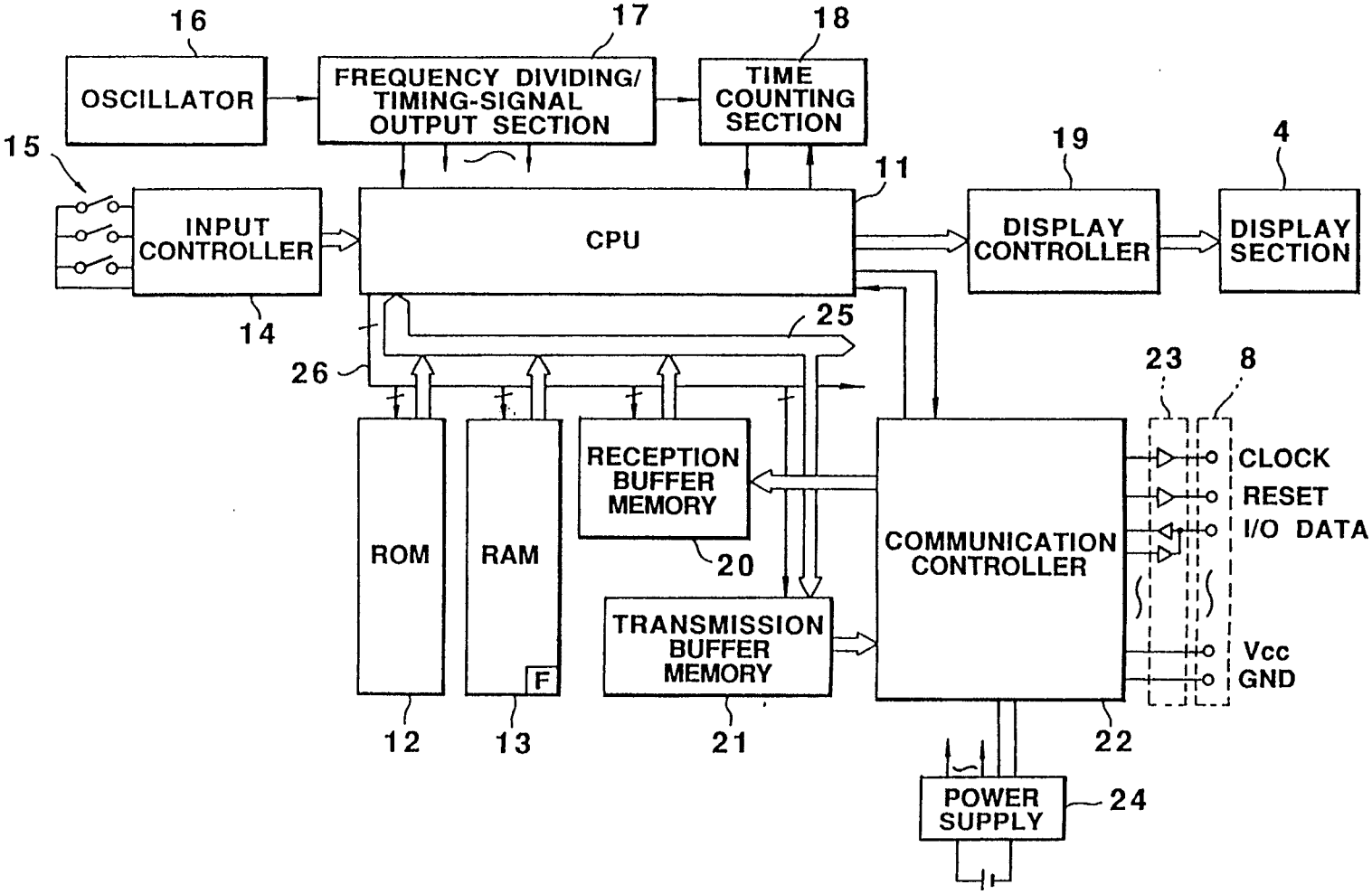
FIG. 4 is a circuit block diagram of the wrist watch in FIG. 1.

A disk-shaped or coin-shaped information storage device 9 is disposed in the memory retaining section 7. The information storage device 9 (whose details will be given later) has a semiconductor device inside on the bottom of which contacts are formed. The contacts of this information storage device (hereinafter called as "IC coin memory") come into contact with the contacts 8 formed in the retaining section 7 when the IC coin memory 9 is housed therein. To ensure secure contact between the contact group of the IC coin memory 9 and the contact group 8 of the retaining section 7, a through-hole 9*a* is formed in the IC coin memory 9 so that the projection 7*a* in the center of the retaining section 7 is fitted in the through-hole 9*a* to restrict the retaining position. The body case 2 has an opening 2*a* formed in the bottom and has a printed circuit board 2*c* disposed inside, with a back cover 2*d* covering the opening 2*a* as shown in FIG. 3. Attached on the printed circuit board 2*c* is a semiconductor device 2*b* in which electronic circuitry to be described referring to FIG. 4 is incorporated. The printed circuit board 2*c* supplies a display drive signal to the display section 4 by means of a flexible connection board 2*e*.

FIG. 4 illustrates the electronic circuitry of the semiconductor device 2*b*.

To a CPU (Central Processing Unit) 11 are connected a ROM (Read Only Memory) 12, a RAM (Random Access Memory) 13, an input controller 14, a frequency dividing/time-signal output section 17, a timer section 18, a display controller 19, a reception buffer memory 20, a transmission buffer memory 21, and a communication controller 22 via a data bus 25, an address/control signal bus 26 and/or other various signal buses (shown).

The ROM 12 stores a program for a watch, a program that permits the wrist watch 1 to function as an electronic information device, various pieces of numerical data and character data. The RAM 13 serves as a memory to store various pieces of data. A coin memory flag F to be described later is provided in the RAM 13.

The CPU 11 controls the individual sections of the wrist watch 1 and the IC coin memory 9 according to the programs in the ROM 12 while using the RAM 13 as a work memory, to execute a process as the wrist watch 1 and a process as an electronic information processing device.

An oscillator 16 outputs a clock signal to the frequency dividing/time-signal output section 17. The frequency dividing/time-signal output section 17 frequency-divides the clock signal from the oscillator 16 to produce a clock signal necessary for the processing in the CPU 11 and various timing signals.

A key input section 15 is a general representative of the various keys 5*a*, 5*b*, 5*c* and 5*d* of the key operation section 5 and the scroll key 6*a* of the scroll section 6. The results of the operation of the individual keys of the key operation section 15 are output via the input controller 14 to the CPU 11.

The display controller 19 supplies a display drive signal to the display section 4 to display various types of information based on a display signal from the controller 11.

The communication controller 22 controls data transfer between the CPU 11 and the IC coin memory 9 connected via the contacts 8 thereto. Particularly in this embodiment, the communication controller 22 performs parallel/serial conversion of data and transfers the serial data to the IC coin memory 9.

The data that is transferred via this communication controller 22 to the IC coin memory 9 is temporarily stored in the transmission buffer 21 before being sent to the IC coin memory 9 via the communication controller 22, an input/output buffer 23 and the contacts 8. The data sent from the IC coin memory 9 is temporarily stored in the reception buffer 20 before being subjected to various processes.

The signals which are exchanged between the CPU 11 and the IC coin memory 9 via the contacts 8 include a control clock signal, a reset signal, data (I/O DATA), and signals from a power supply (vcc and ground GND).

The IC coin memory 9 (whose structure will be described later) has electronic circuitry inside and is designed as indicated by the block diagram given in FIG. 5.

Figure 5:
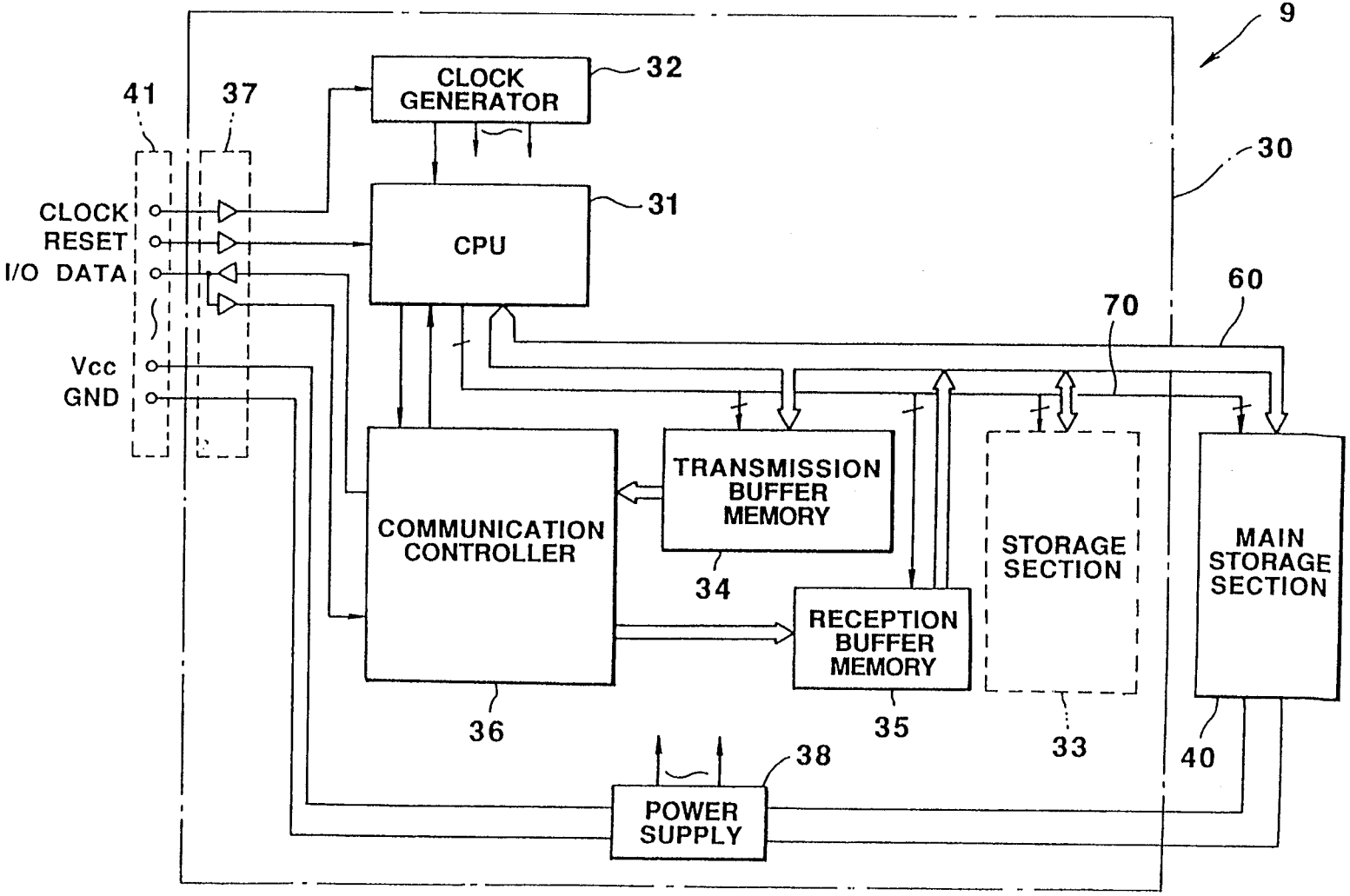
FIG. 5 is a circuit block diagram of an IC coin memory to be installed in the wrist watch.

In FIG. 5, the IC coin memory 9 is provided with a controller 30, a main storage section 40 and contacts 41. The controller 30 includes a CPU 31, a clock generator 32, a storage section 33, a transmission buffer memory 34, a reception buffer memory 35, a communication controller 36, an input/output buffer 37 and a power supply 38. The individual sections of the controller 30, and the controller 30 and the main storage section 40 are connected via a data bus 60 and an address/control signal bus 70.

In the controller 30, the clock generator 32 receives the clock signal from the wrist watch 1. Based on this clock signal, the clock generator 32 produces a clock to be used by the IC coin memory 9 and outputs it to the CPU 31, etc. The CPU 31 receives a reset signal from the wrist watch 1, and controls the start or termination of a process based on this reset signal. Based on the programs and data stored in the storage section 33, the CPU 31 controls the individual sections of the IC coin memory 9, data exchange with the wrist watch 1, and data writing/reading to/from the main storage section 40. The communication controller 36 controls data transfer between the CPU 31 and the wrist watch 1 connected via the contacts 41 thereto. Particularly in this embodiment, the communication controller 36 performs parallel/serial conversion of data and transfers the serial data to the wrist watch 1. The data that is transferred via this communication controller 36 to the wrist watch 1 is read out from the main storage section 40 and temporarily stored in the transmission buffer 34 before being sent to the wrist watch 1 via the communication controller 36, the input/output buffer 37 and the contacts 41. The data sent from the wrist watch 1 is temporarily stored in the reception buffer 35 before being written in the main storage section 40.

The main storage section 40, constituted of an EEPROM, stores various types of information, such as telephone book data, name card data, schedule data and dictionary data. The IC coin memory 9 exchanges the data from the main storage section 40 with the wrist watch 1.

Figure 6:
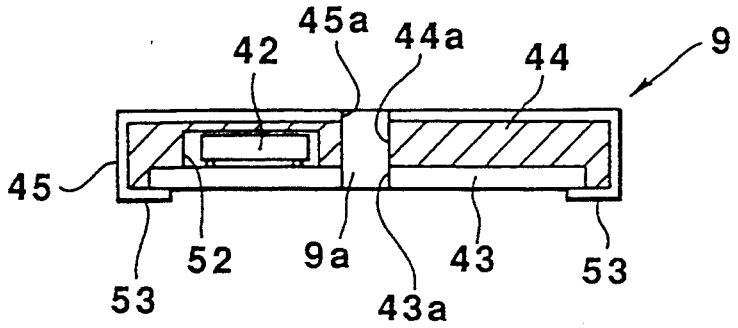
FIG. 6 is a cross section of the IC coin memory.
Figure 7:
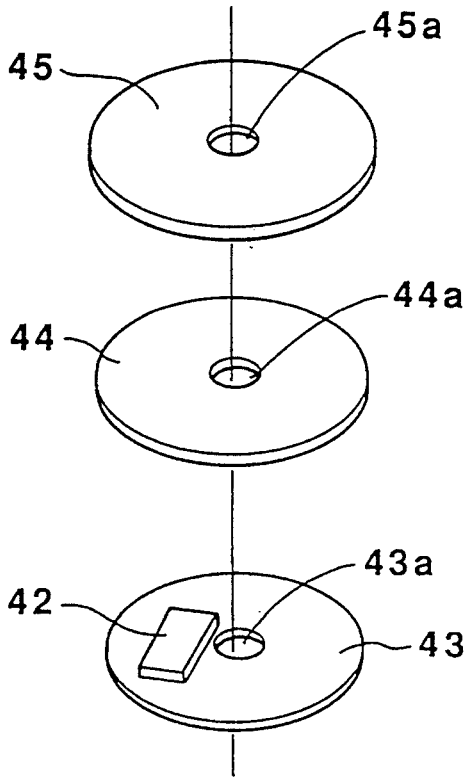
FIG. 7 is an exploded perspective view of the IC coin memory.
Figure 8:
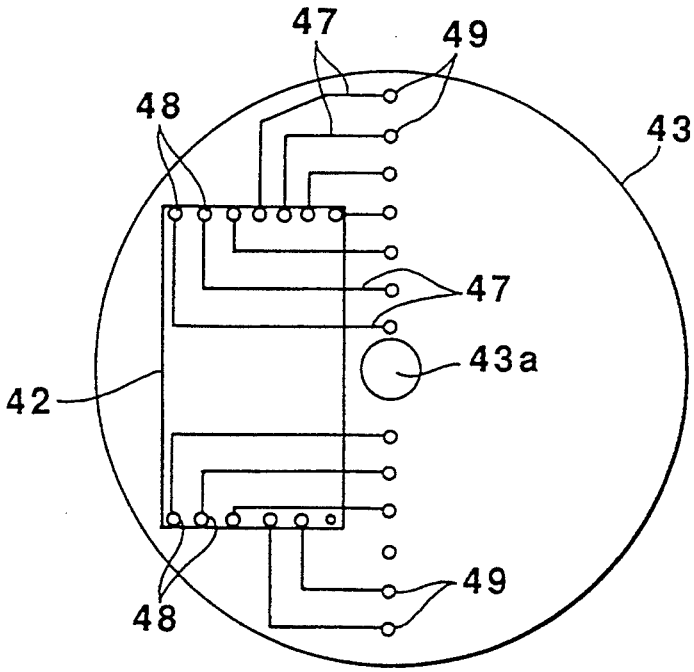
FIG. 8 is a top view of a printed circuit board to be used in the IC coin memory.

FIGS. 6 through 9 illustrate the structure of the IC coin memory 9. As shown in FIGS. 6 through 8, the IC coin memory 9 comprises a printed circuit board 43 on which a semiconductor device 42 such as an LSI having the circuitry as shown in FIG. 4 is mounted, a housing 44 in which the semiconductor-device mounted printed circuit board 43 is fitted from below, and a metal frame 45 which assemble the printed circuit board 43 and the housing 44. The printed circuit board 43, housing 44 and frame 45 have thin circular shapes, so that the IC coin memory 9 having those components assembled together has a circular flat shape. The printed circuit board 43, housing 44 and frame 45 respectively have circular openings 43*a*, 44*a* and 45*a* formed in the center, so that a through-hole 9*a* is formed in the center when they are assembled together. The through-hole 9*a* becomes a reference point to position the IC coin memory 9 described earlier.

Figure 9:
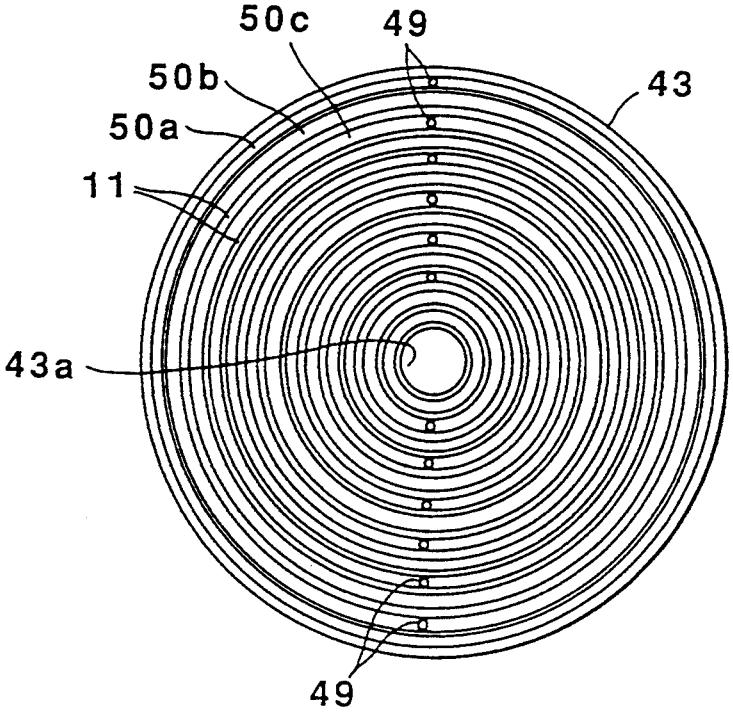
FIG. 9 is a bottom view of a printed circuit board to be used in the IC coin memory.

On the bottom of the printed circuit board 43 are formed connector terminals 48 which electrically couple to the contacts 8 of the wrist watch 1. FIGS. 8 and 9 illustrate the structure of this printed circuit board 43. As shown in FIG. 8 the semiconductor device 42 is mounted at a predetermined position on the upper surface of the printed circuit board 43. Many wirings 47 formed of a conductor are patterned on the top of the printed circuit board 43, so that when the semiconductor device 42 is mounted on the printed circuit board 43, the individual wirings 47 electrically connect at their one ends to the respective terminals 48 provided on the lower surface of the semiconductor device 42. The other ends of the wirings 47 are connected to through-holes 49, which are bored through the printed circuit board 43 in an electrically conductive manner. Formed on the bottom of the printed circuit board 43 are connector terminals 50*a*, 50*b*, 50*c* . . . which are associated with the through-holes 49. As shown in FIG. 9, the connector terminals 50*a*, 50*b*, 50*c* . . . are formed concentrical with the opening 43*a* of the printed circuit board 43 as the center, and are mutually insulated by a concentrical insulation section 51. The connector terminals 50*a*, 50*b*, 50*c*, . . . are to be connected to the terminals of the semiconductor device 42 via the through-holes 49 and the wirings 47. The connector terminals 50*a*, 50*b*, 50*c* . . . are exposed on the bottom of the IC coin memory 9 as shown in FIG. 6, so that they contact the contacts 8 to be electrically coupled thereto when the IC coin memory 9 is installed in the memory retaining section 7 of the wrist watch 1. As shown in FIG. 6, the housing 44 where the printed circuit board 43 is to be fitted has a recess 52 for housing the semiconductor device 42. The frame 45 for assembling the printed circuit board 43 and housing 44 is designed to cover the whole top portion and has a bent ear for supporting the housing 44 and printed circuit board 43.

Figure 10:
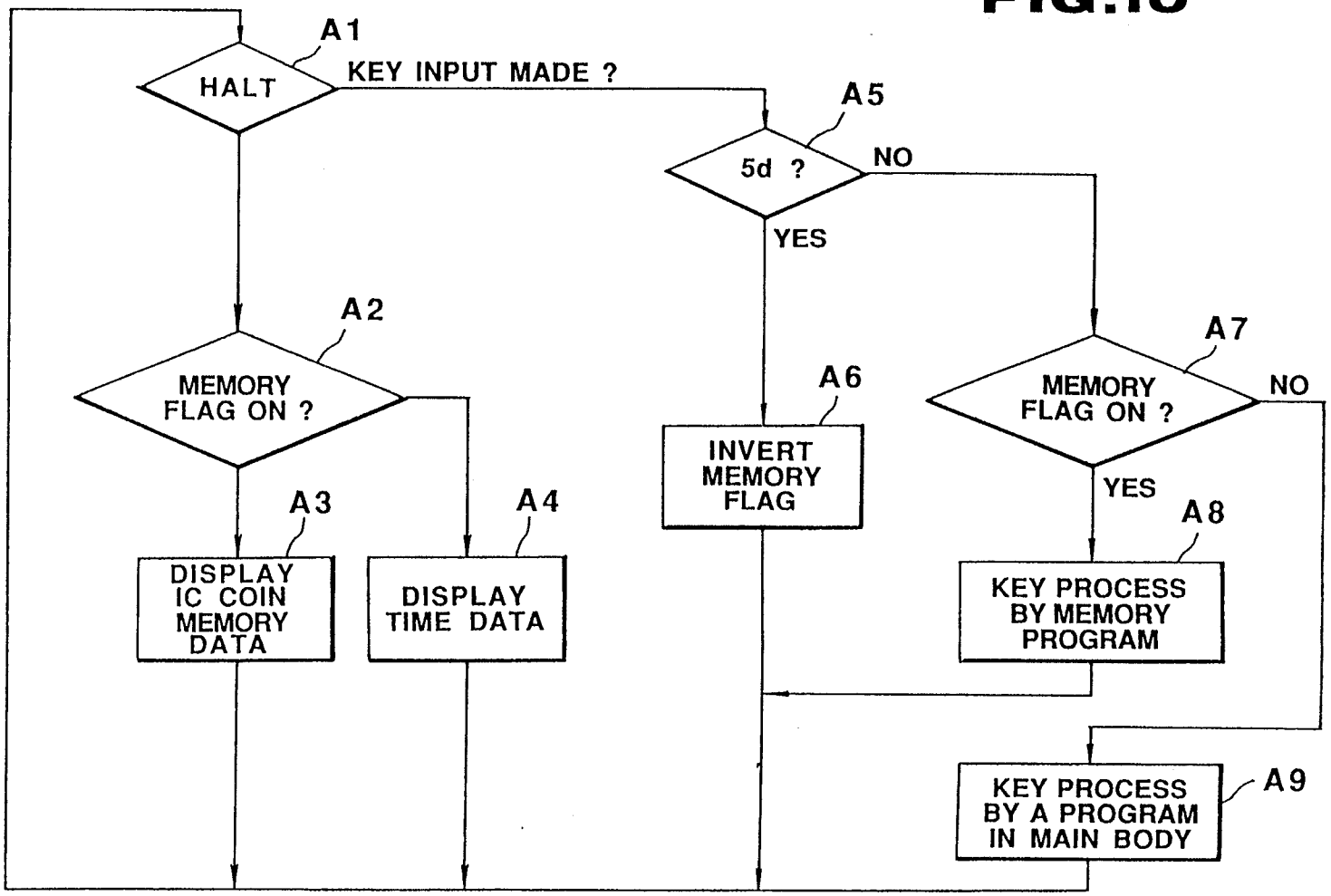
FIG. 10 is a flowchart illustrating the operation of the wrist watch.

The operation of the wrist watch 1 having the above-described structure will be described below. FIG. 10 presents a flowchart illustrating the operation.

Step A1 is a halt state, from which the flow advances to a display process of steps A2 and A3 or A4 every predetermined period, e.g., 1/16 sec. In step A2 it is discriminated whether the coin memory flag F in the RAM 13 in FIG. 4 is on, i.e., "1." With the coin memory flag F being on, the flow advances to step A3 where the data sent from the IC coin memory 9 is displayed. When the coin memory flag F is off or "0," the information of the current time measured by the timer section 18 is displayed in step A4.

When there is a key input from the key operation section 5 in step A1, the flow goes to step A5 where it is determined if the key input is from the mode select key 5*d*. If the key input event is originated from the mode select key 5*d*, the flow advances to step A6 where the content of the coin memory flag F is switched to change the mode. When it is determined in step A5 that the key input event has not occurred by the mode select key 5*d*, the flow advances to step A7 where it is determined whether the coin memory flag F is on or off. When the coin memory flag F is on, the flow goes to step A8 where the keys 5*a* to 5*c* and the scroll key 6*a* are controlled by the control programs in the IC coin memory 9 to serve as keys to read or write data from or into the IC coin memory 9 or keys for display control. When the coin memory flag F is off, the flow advances to step A9 where the keys 5*a* to 5*c* are controlled by the control programs in the ROM 12 to serve as keys for time setup or correction or control for the other functions of the wrist watch 1.

The wrist watch 1 is used with the cover 3 closed (see FIG. 1) in the above manner, various types of information is displayed on the display section 4, so that the wrist watch 1 can serve as a watch or an electronic information device. Even with the IC coin memory 9 uninstalled in the retaining section 7, the controller 11 of the wrist watch 1 controls the individual sections according to the programs in the ROM 12 to function as a watch, displaying the day of the week, time, etc. on the display section 4.

To use this wrist watch 1 as an electronic information device, the user opens the cover 3, places the IC coin memory 9 in the retaining section 7, closes the cover 3, operates the mode select key 5*d* to set the memory flag F on, and then operates the keys 5*a* to 5*c* or the key 6*a* to perform various types of information processing.

As this cover 3 is provided on the top of the wrist watch 1, it can be open and closed easily to install or detach the IC coin memory 9, thus facilitating the installation and detachment of the IC coin memory 9. with the cover 3 closed, the connector terminals 50*a*, 50*b* . . . are pressed against the contacts 8 to ensure stable electric contact.

Since the projection 7*a* is provided in the center of the memory retaining section 7 and the through-hole 9*a* is provided in the center of the IC coin memory 9, it is easy to position the IC coin memory 9 when installing in the retaining section 7 and is possible to ensure stable electric connection.

According to this embodiment, in short, the surface space of the wrist watch 1 can effectively be used, so that the wrist watch 1 capable of serving as an electronic information device can be made compact, improving the portability.

Figure 11:
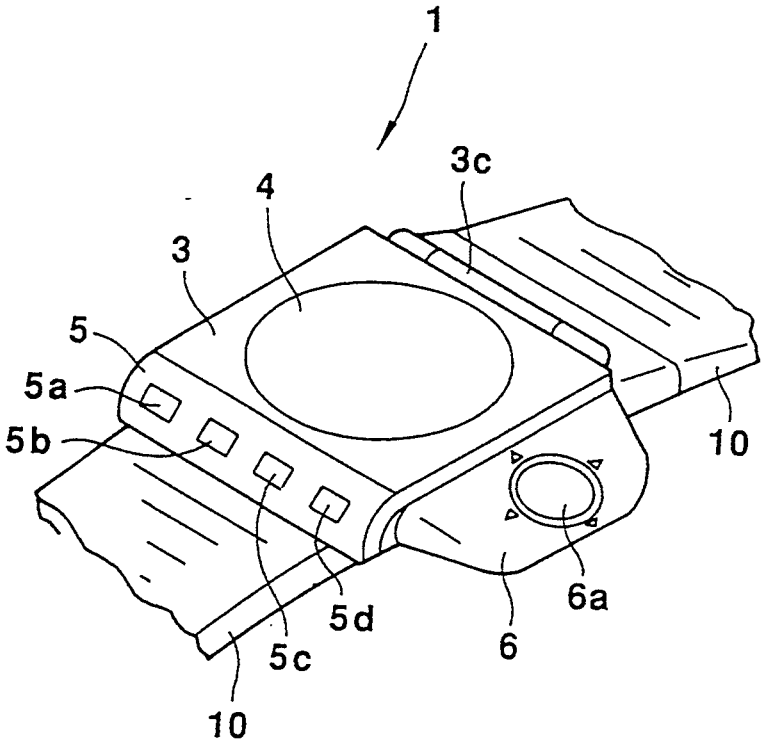
FIGS. 11 and 12 are perspective views of a wrist watch according to the second embodiment of the present invention.
Figure 12:
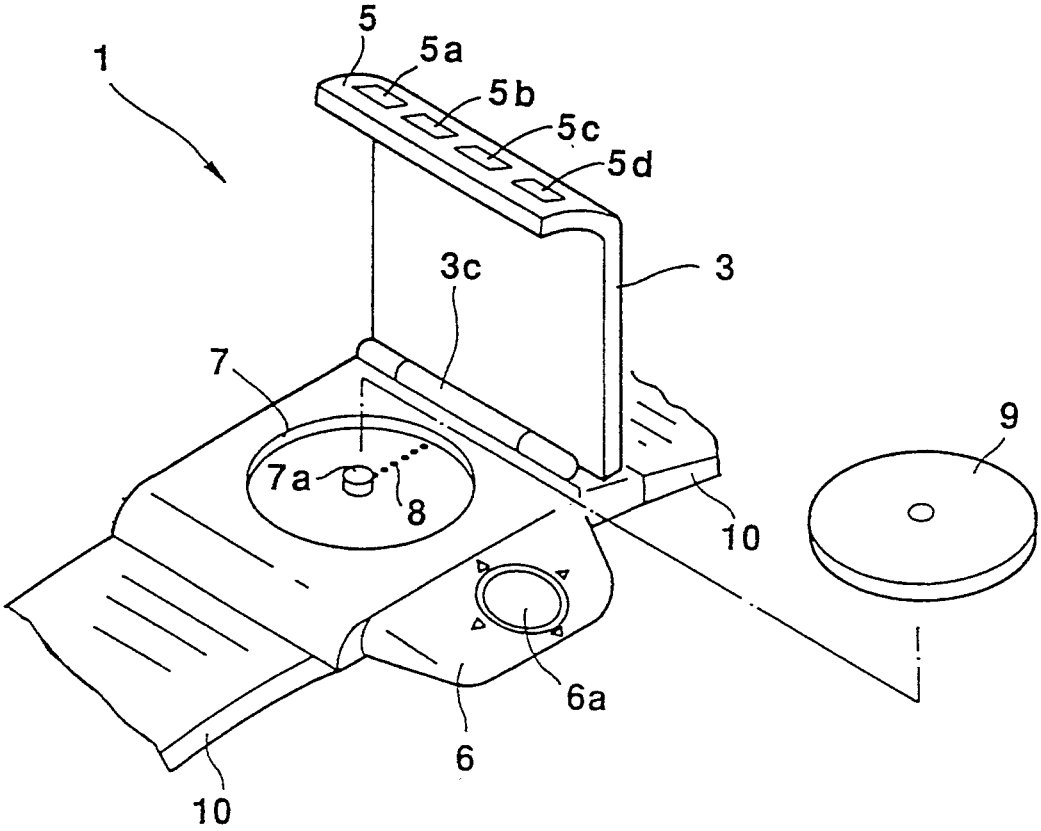

Although the key operation section 5 is provided in the body case 2 in this embodiment, the key operation section 5 may be provided in the cover 3 as shown in FIGS. 11 and 12. Since the wrist watch in FIGS. 11 and 12 has the same structure as the wrist watch 1 according to the first embodiment, except for the key operation section 5, like reference numerals are given to like portions to avoid their detailed description.

Second Embodiment

FIGS. 13 to 19 illustrate another embodiment of the present invention.

Figure 13:
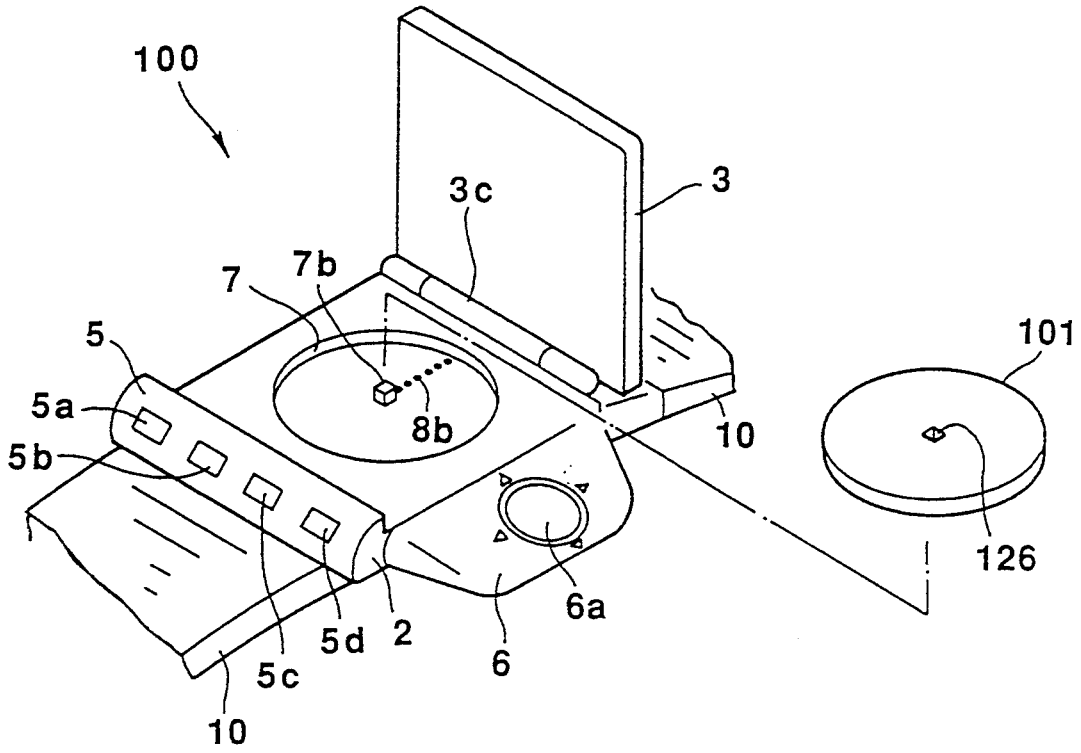
FIG. 13 presents a perspective view of a wrist watch according to the third embodiment of the present invention.

A wrist watch 100 shown in FIG. 13 is shaped almost the same as the wrist watch 1 shown in FIGS. 1 and 2. Like or same reference numerals are used to denote those sections in FIG. 13 corresponding or identical to the sections in FIGS. 1 and 2 so as to avoid their detailed explanation. A projection 7*b* is formed in the shape of a square pole in the center of the bottom of the memory retaining section 7. On the bottom of the projection 7*b* opposite to the position of this projection 7*b*, a contact group 8*b* including eight contacts is arranged in a line perpendicular to one side of the projection 7*b*.

An IC coin memory 101 shown in FIG. 13 is retained in the memory retaining section 7.

Figure 14:
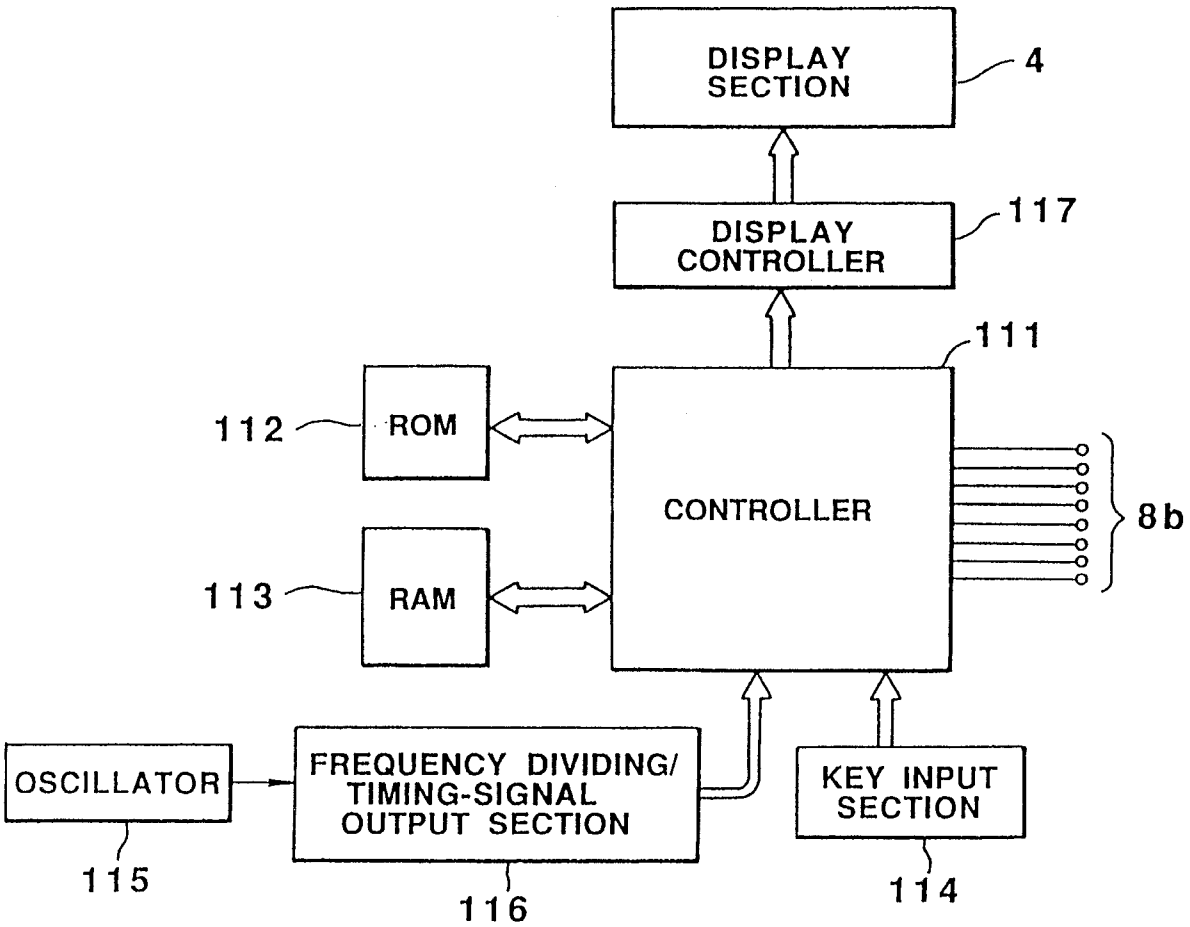
FIG. 14 is a circuit block diagram of the wrist watch according to the third embodiment.

An electronic circuitry in the wrist watch 100 is designed as shown in a block diagram of FIG. 14.

In FIG. 14, connected to a controller 111 are a (Read Only Memory) 112, a RAM (Random Access Memory) 113, a key input section 114, a frequency dividing/timing-signal output section 116 and a display controller 117. Further, the contacts of the contact group 8*b* are individually connected to the controller 111.

The ROM 112 stores a program for operating the wrist watch 100 as a time piece, a program for operating the wrist watch 100 as an electronic information device, or the like. In the RAM 113 having a memory area 113*a*, time data calculated by the controller 111 is stored. The RAM 113 serves also as a work memory for various functions.

Using the RAM 113 as a work memory and according to the programs in the ROM 112, the controller 111 controls the individual sections of the wrist watch 100 and the IC coin memory 101 to execute a process not only for a wrist watch but also for an electronic information device.

An oscillator 115 generates a clock signal and sends it to the frequency dividing/timing-signal output section 116. The frequency dividing/timing-signal output section 116 then frequency-divides the clock signal from the oscillator 115, outputting a clock signal needed for a process of the controller 111 and various timing signals.

The key input section 114 is a general representative of the keys 5*a*, 5*b*, 5*c* and 5*d* of the key operational section 5 and the scroll key 6*a* of the scroll section 6.

Based on a signal from the controller 111, the display controller 117 controls the display section 4 to display various types of information.

Figure 15:
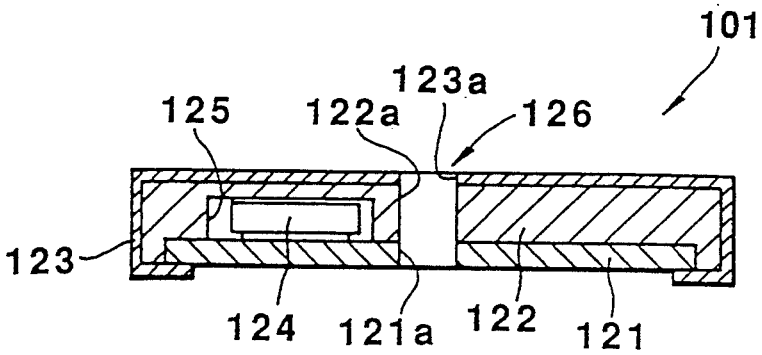
FIG. 15 is a cross section of an IC coin memory 101 shown in FIG. 13.
Figure 16:
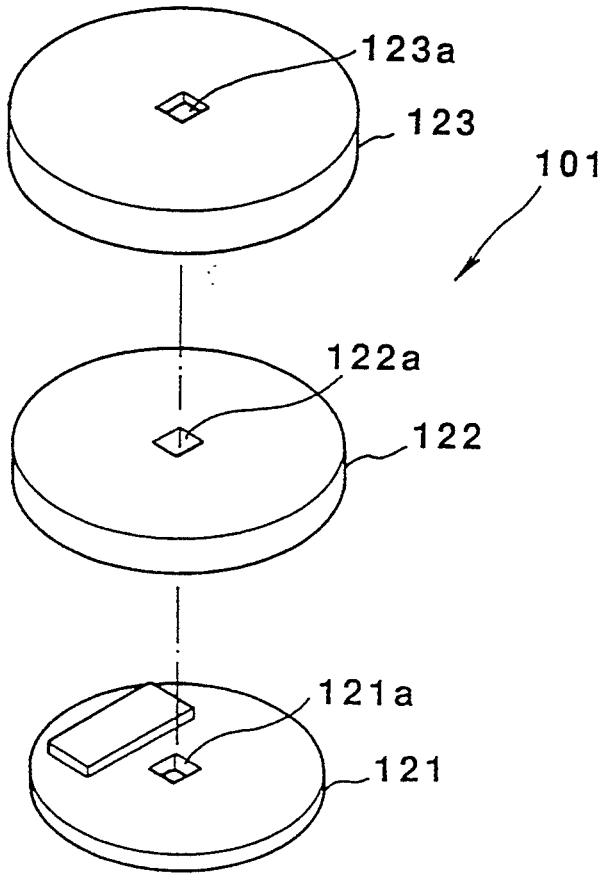
FIG. 16 is an exploded perspective view of the IC coin memory 101 in FIG. 13.
Figure 19:
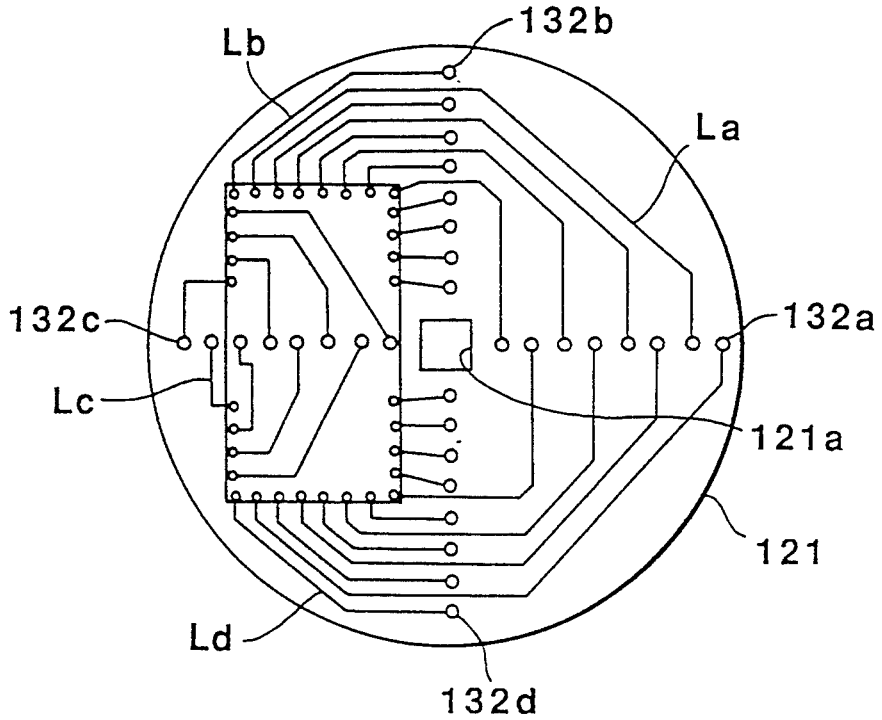
FIG. 19 is a bottom view of the printed circuit board to be used in the IC coin memory 101.

The IC coin memory 101 has a printed circuit board 121, a housing 122 and a frame 123 laminated as shown in FIGS. 15 and 16. An IC memory 124 is installed in the printed circuit board 121 and a printed wiring is provided therein as shown in FIG. 19. The printed circuit board 121 is covered with the housing 122 made of a synthetic resin. The housing 122 has a chamber 125 for retaining the IC memory 124 which is installed in the printed circuit board 121. The housing 123 and the printed circuit board 121 are assembled together by the frame 123. The printed circuit board 121, the housing 122 and the frame 123 are formed in a disk shape (thin cylinder shape). The IC coin memory 101 into which these components are assembled is also formed in a disk shape.

The printed circuit board 121, the housing 122 and the frame 123 as components of the IC coin memory 101 have square holes 121*a*, 122*a* and 123*a* in the center, respectively. These holes 121*a*, 122*a* and 123*a* of the respective components communicate with one another to provide a through-hole 126 of the IC coin memory 101, as shown in FIG. 15. If the through-hole 126 is fitted over the projection 7*b* in the memory retaining section 7 of the wrist watch 100, the installation angle and position of the IC coin memory 101 in the memory retaining section 7 can be set. The projection 7*b* of the memory retaining section 7 and the through-hole 126 of the IC coin memory 101 constitute angle defining means for defining the installation angle of the IC coin memory 101 in the memory retaining section 7.

Figure 17:
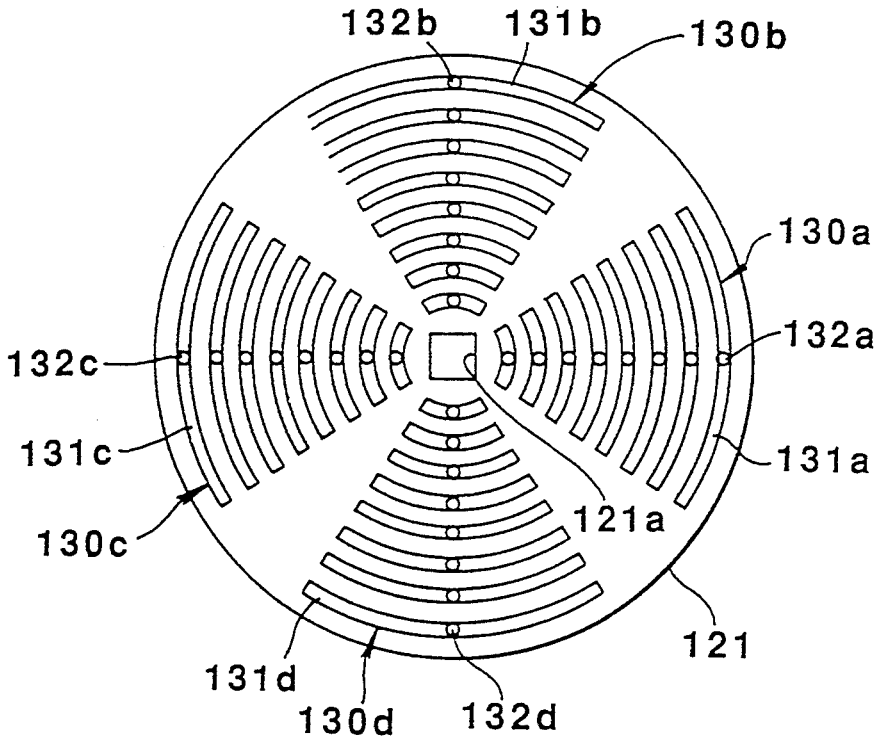
FIG. 17 is a bottom view of a printed circuit board to be used in the IC coin memory 101.

As shown in FIG. 17, four contact groups 130*a*, 130*b*, 130*c* and 130*d* are formed in the lower surface of the printed circuit board 121. Each of the contact groups 130*a*, 130*b*, 130*c* and 130*d* are constituted respectively by eight contacts 131*a*, 131*b*, 131*c* and 131*d* and through-holes 132*a*, 132*b*, 132*c* and 132*d* formed in the respective contacts. The contacts 131*a*, 131*b*, 131*c* and 131*d* of the respective contact groups 130*a*, 130*b*, 130*c* and 130*d* are formed concentrical to one another in a fan shape from the center of the IC coin memory 101 toward the external wall. Further these contact groups 130*a*, 130*b*, 130*c* and 130*d* are formed at the positions opposite to the corresponding sides of the hole 121*a*. When the IC coin memory 101 is to be installed in the retaining section 7 of the wrist watch 101, the through-hole 126 of the IC coin memory 101 is fitted over the projection 7*b* of the retaining section 7, ensuring that one of the contact groups 130*a*, 130*b*, 130*c* and 130*d* of the IC coin memory 101 contacts the contact group 8*b* of the wrist watch 100. Moreover, the fitting angle of the through-hole 126 of the IC coin memory 101 to the projection 7*b* is to be changed by 90° as needed, ensuring that one of the contact groups 130*a*, 130*b*, 130*c* and 130*d* of the IC coin memory 101 is sequentially selected to come into contact with the contact group 8*b*.

Figure 18:
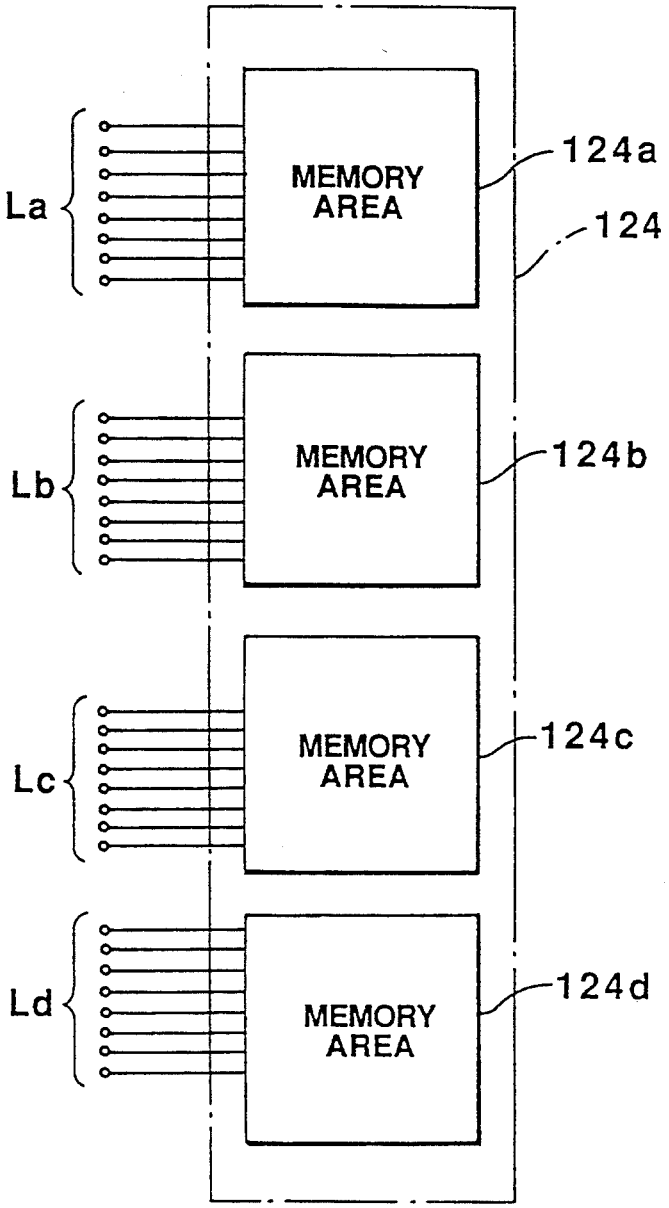
FIG. 18 is a circuit block diagram of the IC coin memory 101.

The IC memory 124 attached to the IC coin memory 101 is divided into four data memory areas 124*a*, 124*b*, 124*c* and 124*d* as shown in FIG. 18. The memory areas 124*a*, 124*b*, 124*c* and 124*d* constituted by, for example, an EEPROM are connected to their own lead lines La, Lb, Lc and Ld, respectively. The memory areas 124*a*, 124*b*, 124*c* and 124*d* store data about telephone numbers and business cards, schedule data, and dictionary data, for example.

As shown in FIG. 19, the lead lines La, Lb, Lc and Ld of the memory areas 124*a*, 124*b*, 124*c* and 124*d* in FIG. 18 are wired on the top surface of the printed circuit board 121 having the IC coin memory 101 thereon to the through-holes 132*a*, 132*b*, 132*c* and 132*d* of the contact groups, formed in the reverse side of the IC coin memory 101. With the lead lines La, Lb, Lc and Ld wired in this manner, the memory areas 124*a*, 124*b*, 124*c* and 124*d* of the IC coin memory 101 are connected respectively to the contact groups 130*a*, 130*b*, 130*c* and 130*d* formed on the reverse side of the IC coin memory 101. The 124*a*, 124*b*, 124*c* and 124*d* of the IC coin memory 101 are therefore connectable to the contact group 8*b* of the wrist watch 100 via the contact groups 130*a*, 130*b*, 130*c* and 130*d*.

The action of this embodiment will now be described.

The wrist watch 100 keeps its cover 3 closed in the normal use and displays various information in the display section 4. Even without installing the IC coin memory 101 in the retaining section 7, the controller 11 will control the individual sections by a program in the ROM 112, So that the wrist watch 100 serves as a watch and displays time data, such as the day of the week and time, in the display section 4.

To use the wrist watch 100 also as an electronic information device, the user opens the cover 3 to install the IC coin memory 101 in the retaining section 7, closes the cover 3 and then operates some keys to perform various information processing. The flowchart of the operation in this-case is the same as the one shown in FIG. 10.

In setting the IC coin memory 101 to the retaining section 7, since the projection 7*b* and the through-hole 126 both having a square cross section are formed respectively in the center of the retaining section 7 and the IC coin memory 101, the installation angle of the IC coin memory 101 in the retaining section 7 is defined.

The IC coin memory 101 has memory areas 124*a*, 124*b*, 124*c* and 124*d*. The contact groups 130*a*, 130*b*, 130*c* and 130*d* are provided on the back of the IC coin memory 101 for the associated memory areas 124*a*, 124*b*, 124*c* and 124*d* to access those memory areas. Centering around the through-hole 126 of the IC coin memory 101, the contact groups 130*a*, 130*b*, 130*c* and 130*d* are formed at positions corresponding to the sides of the through-hole 126. The contact group 8*b* is provided on the bottom of the retaining section 7 to contact the contact groups 130*a*, 130*b*, 130*c* and 130*d* of the IC coin memory 101. The contact group 8*b* is arranged only in one line perpendicularly to the side of the projection 7*b*.

In installing the IC coin memory 101 into the retaining section 7, the fitting angle of the through-hole 126 of the IC coin memory 101 over the projection 7*b* is selected as needed, permitting one of the contact groups 130*a*, 130*b*, 130*c* and 130*d* of the IC coin memory 101 to be selected as needed in order to contact the contact group 8*b*. As a result, the controller 111 of the wrist watch 100 can access one of the connected memory areas 124*a*, 124*b*, 124*c* and 124*d*, and the wrist watch 100 can serve as an electronic information device using information stored in one of the memory areas 124*a*, 124*b*, 124*c* and 124*d* of the IC coin memory 101. If the installation angle of the IC coin memory 101 having the memory areas 124*a*, 124*b*, 124*c* and 124*d* to the retaining section 7 is therefore selected as necessary, data to be displayed by the wrist watch 100 as an electronic information device is easily and surely selected. Without an external memory prepared for each application, simply changing the installation angle of one IC coin memory 101 can permit the wrist watch 100 to be used for various purposes. The utilization and convenience of the wrist watch can be improved.

In the above-described embodiment, the projection 7*b* in the center of the retaining section 7 and the through-hole 126 in the center of the IC coin memory 101 are used to define the installation angle of the IC coin memory 101. The means of defining this angle is not limited to the use of these components. For example, a projection or a recess may be formed in the external wall of the IC coin memory 101, and a projection or a recess may be formed in the internal wall of the retaining section 7 to be fitted over the corresponding recess or projection.

Third Embodiment

Figure 20:
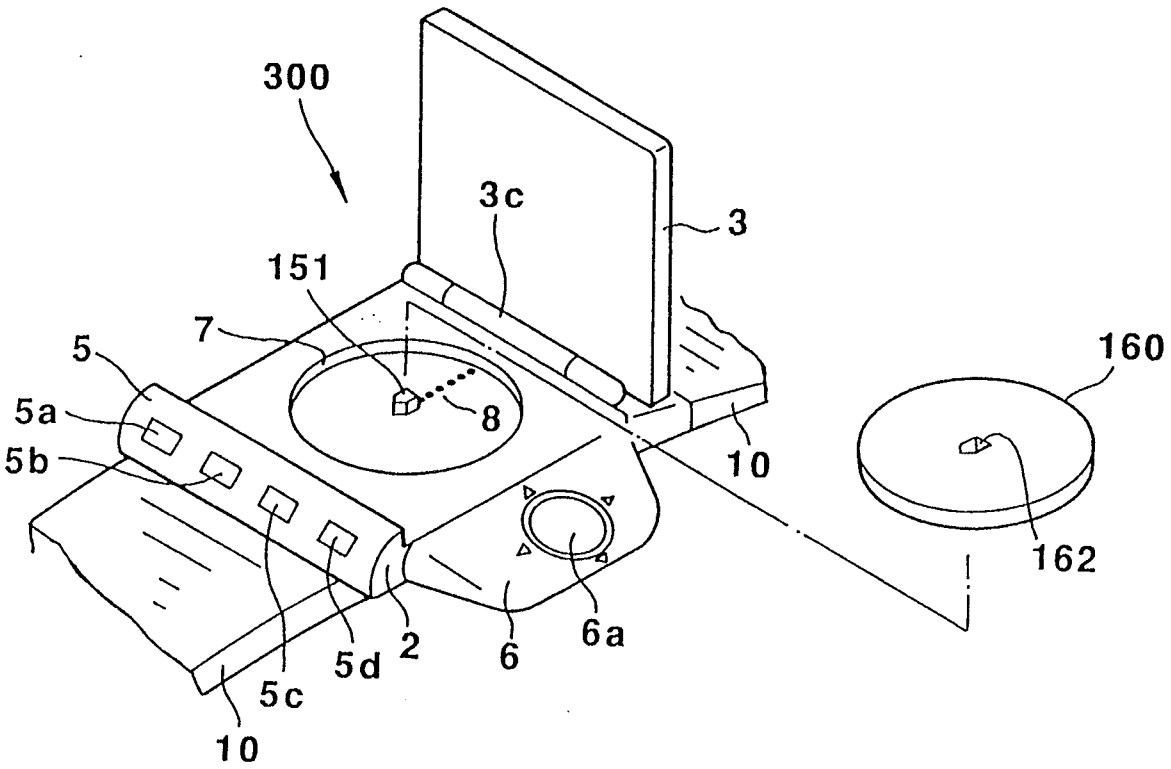
FIG. 20 is a perspective view of a modification of the wrist watch of the present invention.
Figure 21:
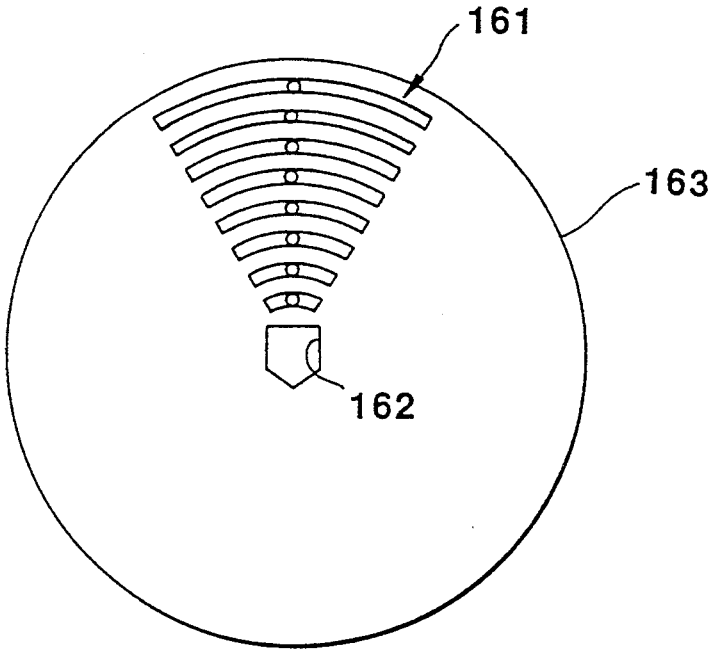
FIG. 21 is a bottom view of an IC coin memory to be used in the wrist watch in FIG. 20.

FIGS. 20 and 21 illustrate another embodiment of the present invention.

A wrist watch 300 shown in FIG. 20 has almost the same structure as the wrist watch 1 shown in FIGS. 1 and 2, so that like reference numerals are given to like sections to avoid their detailed description. The difference from the wrist watch 1 in FIGS. 1 and 2 lies in that a projection 151 of the memory retaining section 7 is formed into a pentagonal column. The internal circuit structure of the wrist watch 300 is the same as shown in FIG. 4. While an IC coin memory 160 is designed almost in the same manner as the one shown in FIGS. 6 and 7, a through-hole 162 is formed into a pentagonal shape, the same way as the projection 151. As shown in FIG. 21, connector terminals 161 at the bottom of a printed circuit board 163 of the IC coin memory 160 are arranged in a fan shape only at that position which faces one side of the through-hole 162. The IC coin memory 160 has the same internal circuit structure as what is shown in FIG. 5.

With this arrangement, to use the wrist watch 300 as an electronic information device, the user opens the cover 3 to place the IC coin memory 160 in the retaining section 7. At this time, the pentagonal columnar projection 151 is provided in the center of the retaining section 7, and the pentagonal through-hole 162 in the center portion of the IC coin memory 160. The IC coin memory 160 is therefore accommodated in the retaining section 7 by fitting the projection 151 into the through-hole 162. In this case, since the projection 151 and the through-hole 162 are formed pentagonal, the former can be fitted into the latter when they engage with each other at a predetermined angle. When the IC coin memory 160 is installed in the retaining section 7 only at a given installation angle, contacts 161 of the IC coin memory 160 come into contact with the contacts 8 of the retaining section 7. As a result, the contacts 161 can surely contact the contacts 8 of the retaining section 7 by retaining the IC coin memory 160 into the retaining section 7 in such a way as to fit the projection 151 into the through-hole 162.

Fourth Embodiment

Figure 22:
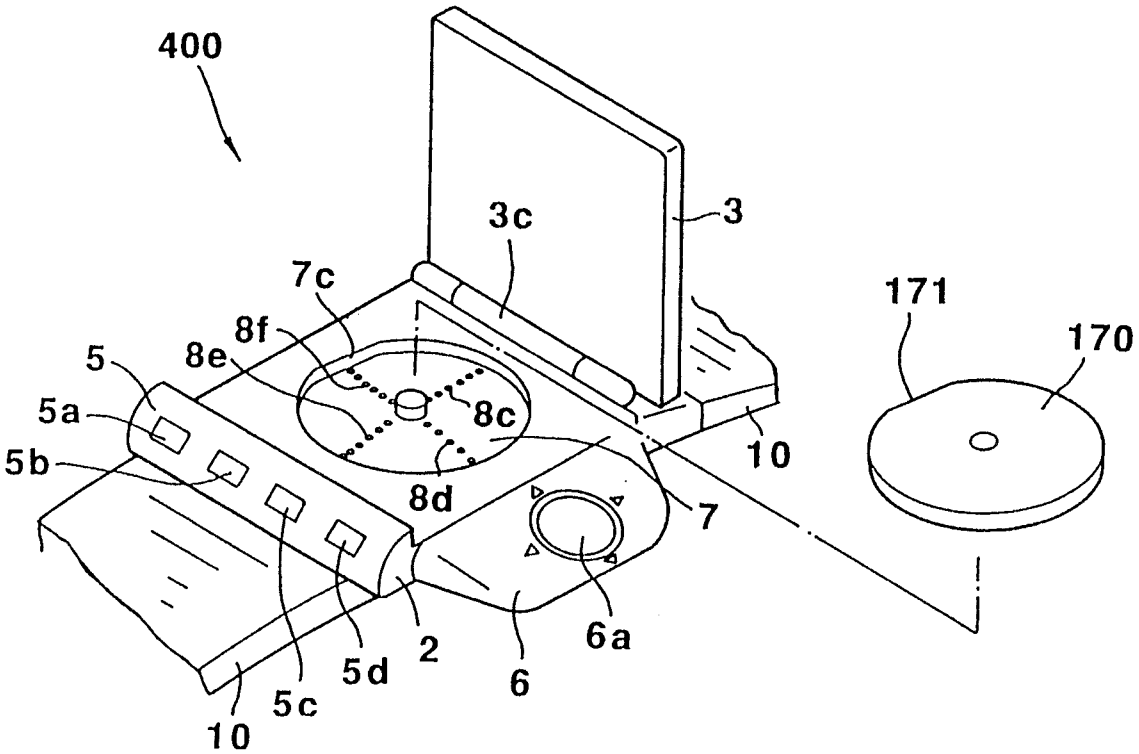
FIG. 22 presents a perspective view of a wrist watch according to the fourth embodiment of the present invention.
Figure 23:
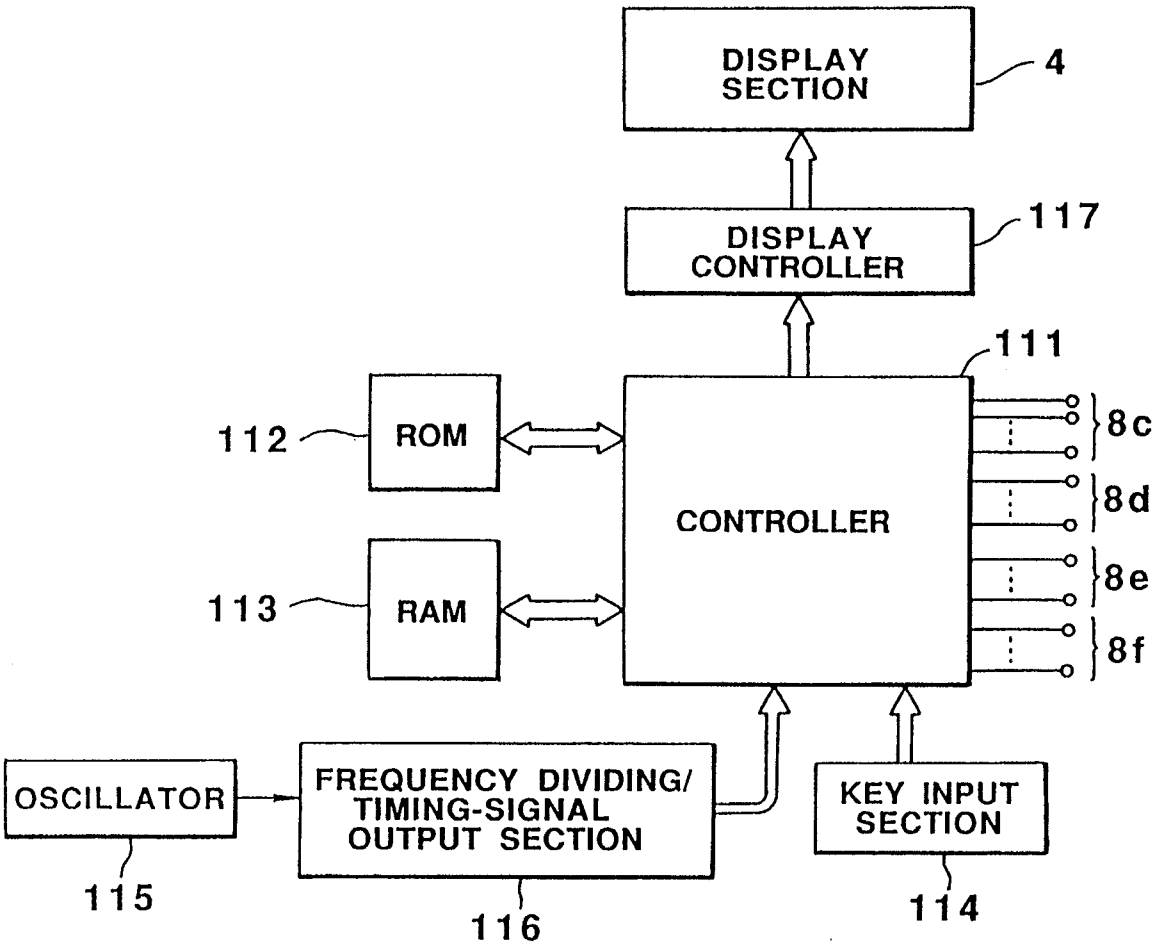
FIG. 23 is a circuit block diagram of the wrist watch shown in FIG. 22.

FIGS. 22 and 23 illustrate the fourth embodiment of the present invention.

A wrist watch 400 shown in FIG. 22 has almost the same structure as the wrist watch 1 shown in FIGS. 1 and 2, so that like reference numerals are given to like sections to avoid their detailed description. The difference from the wrist watch 1 in FIGS. 1 and 2 lies in that part of the inner surface of the memory retaining section 7 is a straight wall 7*c* and four rows of contacts 8*c*, 8*d*, 8*e* and 8*f* are provided at 90 degrees apart from each other in the memory retaining section 7. The internal circuit structure of the wrist watch 400 is as shown in FIG. 23. That is, the structure shown in FIG. 23 is substantially the same as the one shown in FIG. 14, the only difference lying in that the controller 11 are electrically connected to the contact groups 8*c*, 8*d*, 8*e* and 8*f*.

While an IC coin memory 170 in FIG. 20 is designed almost in the same way as the one shown in FIGS. 15 to 19, the only difference lies in that the IC coin memory 170 has a straight side surface 171 which engages with the wall 7*c* of the inner surface of the memory retaining section 7.

In this embodiment, the IC coin memory 170 can be accommodated into the memory retaining section 7 only when the straight side surface 171 matches the wall 7*c* of the inner surface of the retaining section 7. In the engaged state, a plurality of electrodes (130*a*, 130*b*, 130*c* and 130*d* in FIG. 17) on the bottom of the IC coin memory 170 respectively contact the contact groups 8*c*, 8*d*, 8*e* and 8*f* of the memory retaining section 7. Therefore, different pieces of data stored in the IC coin memory 170 (those data stored respectively in the memory areas 124*a* to 124*d* in FIG. 18) can be controlled without changing the installation position of the IC coin memory 170.

The through-hole 162 is formed pentagonal, the same as the projection 151. As shown in FIG. 21, the connector terminals 161 at the bottom of the printed circuit board 163 are arranged in a fan form only at that position which faces one side of the through-hole 162. The internal circuit structure of the IC coin memory 160 is the same as shown in FIG. 5.

Figure 24:
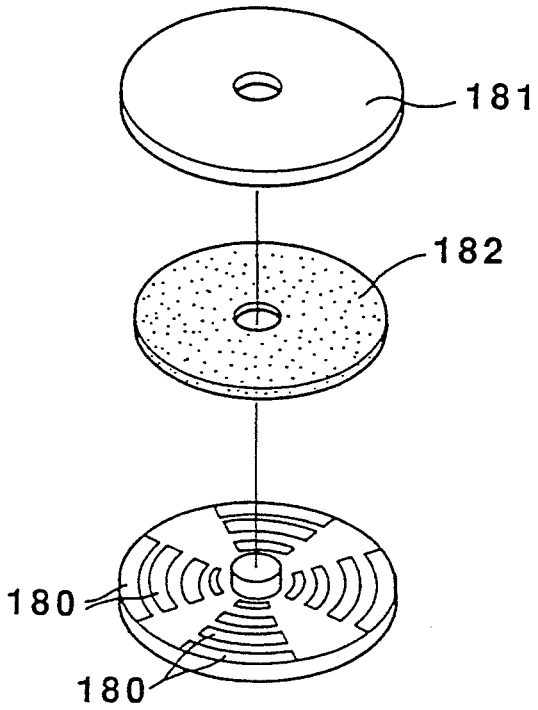
FIG. 24 is a perspective view illustrating the attachment structure of an IC coin memory.

The present invention is not limited to the above-described embodiments, but may be modified in various other manners. For instance, the contact groups of the memory retaining section 7 may be patterned into fan-shaped electrodes 180 as shown in FIG. 24. In addition, a flexible conductive member 182 may be placed between the contact groups of the memory retaining section 7 and an IC coin memory 181 to provide electric connection therebetween. In this case, the conductive member 182 can be formed by so arranging many conductive synthetic resins in an insulative synthetic resin as to penetrate the latter resin.

Although the foregoing description of the individual embodiments has been given with reference to the case where the electronic device embodying the present invention is applied to a wrist watch, this invention can also be applied to other electronic devices, such as a small computer, portable telephone, paging device, electronic book and electronic notebook.

Further, the shape and functions of the IC coin memory are not limited to those of the above-described embodiments. For instance, another non-volatile memory may be used as a data memory which is accessed for information storage and readout into and from a wrist watch. Furthermore, only a read only type memory may be provided. To use a non-volatile RAM as a data memory, a backup battery may be incorporated in the IC coin memory.

We claim:

1. An electronic wrist watch device having means for permitting detachable installation of an external data storage medium, said electronic wrist watch having electronic circuitry means including a time-measuring section for measuring time and a display section for displaying the measured time, the electronic wrist watch further comprising:

a substantially disk-shaped external data storage medium for storing data, said external data storage medium having output terminals for outputting said stored data;

a wrist watch case having a substantially columnar retaining section formed at an upper portion of said wrist watch case for accommodating said external data storage medium therein;

a cover member attached to said wrist watch case for opening and closing said retaining section, and for holding said external data storage medium retained in said retaining section when said cover member is in a closed position to close said retaining section, said cover member comprising an optical display device at an upper surface of said cover member such that said optical display device is viewable by a user when said cover member is in said closed position;

said electronic circuitry means further including means, for measuring a current time and for outputting a first display signal for displaying the current time, and means for receiving data stored in said external data storage medium and for supplying a second display signal based on the received data; and signal transfer means for supplying said first and second display signals output from said electronic circuitry means to said optical display device.

2. An electronic wrist watch device according to claim 1, wherein said output terminals of said external data storage medium are arranged in a concentric shape.

3. An electronic wrist watch device according to claim 1, further comprising connector terminals in said substantially columnar retaining section of said wrist watch case and which are arranged to be coupled to said output terminals of said external data storage medium when said external data storage medium is received in said columnar retaining section of said wrist watch case.

4. An electronic wrist watch device according to claim 1, further comprising a position restricting means for positioning said external data storage medium is formed in a center portion of said columnar retaining section of said wrist watch case.

5. An electronic wrist watch device according to claim 4, wherein said position restricting means section includes a columnar projection.

6. An electronic wrist watch device according to claim 1, wherein said wrist watch case further comprises a control switch operable for supplying data stored in said external data storage medium to said electronic circuitry means.

7. An electronic wrist watch device according to claim 1, wherein said cover member further comprises a control switch operable for supplying data stored in said external data storage medium to said electronic circuitry means.

8. An electronic wrist watch device according to claim 1, further comprising display switching means for selectively displaying the content of said first display signal and the content of said second display signal on said optical display device.

9. An electronic wrist watch device according to claim 1, wherein:

said external data storage medium comprises a plurality of data storage means for storing a plurality of different pieces of data;

said output terminals comprise a plurality of groups of output terminals for respectively supplying data stored in said plurality of data storage means; and said retaining section of said wrist watch case comprises connector terminals adapted to be electrically connected to one of said plurality of groups of output terminals.

10. An electronic wrist watch device according to claim 9, wherein said connector terminals of said retaining section are electrically connected to another group of said plurality of groups of output terminals by changing an installation position of said external data storage medium.

11. An electronic wrist watch device according to claim 9, wherein said output terminals each comprise a plurality of concentrically arranged arc-shaped electrodes.

12. An electronic wrist watch device according to claim 1, wherein said external data storage medium comprises an EEPEOM for storing said data.

13. An electronic wrist watch device according to claim 1, wherein said data stored in said external data storage medium includes program data.

14. An electronic wrist watch device according to claim 1, wherein said output terminals of said external storage medium are arranged in a concentric arc shape.

* * * * *